United States Patent [19]

Pierrat

[11] 4,377,190

[45] Mar. 22, 1983

[54] LOG SPLITTER

[76] Inventor: Michel A. Pierrat, 48 Farrwood Dr., Andover, Mass. 01810

[21] Appl. No.: 169,154

[22] Filed: Jul. 15, 1980

Related U.S. Application Data

[63] Continuation of Ser. No. 873,060, Jan. 27, 1978, abandoned.

[51] Int. Cl.[3] ..... B27L 7/00

[52] U.S. Cl. ..... 144/193 A; 24/257; 248/218.4; 254/93 H

[58] Field of Search ..... 144/3 K, 193 R, 193 A, 144/193 K, 193 D, 193 E; 60/DIG. 10, 417; 248/218.4, 230, 410; 24/115 G, 115 H, 81 CC, 257; 254/93 R, 93 H

[56] References Cited

U.S. PATENT DOCUMENTS

| | | | |
|---|---|---|---|
| 2,034,605 | 3/1936 | Carman | 254/93 H |
| 2,608,766 | 9/1952 | Trammel | 24/257 R |
| 2,704,093 | 3/1955 | Brown | 144/193 A |
| 2,851,072 | 9/1958 | Gerjets et al. | 144/193 A |
| 3,285,304 | 11/1966 | Fuller | 144/193 A |
| 3,494,583 | 2/1970 | Parr | 248/218.4 |
| 3,982,572 | 9/1976 | Kortendick | 144/193 R |
| 4,102,373 | 7/1978 | Winiasz | 144/193 A |

FOREIGN PATENT DOCUMENTS

| | | | |
|---|---|---|---|
| 210512 | 3/1956 | Australia | 144/193 A |
| 1006575 | 4/1952 | France | 144/193 K |
| 605068 | 9/1978 | Switzerland | 144/194 |

*Primary Examiner*—W. D. Bray

*Attorney, Agent, or Firm*—E. Thorpe Barrett

[57] ABSTRACT

A log splitter having a manually adjustable wedge and a power driven base for supporting the log and forcing it upwardly into the splitting wedge. The wedge is supported by a carriage that is releasably secured to two standards by a pair of quick-release clamps, operable with one hand. The support includes a central projection extending toward and in alignment with the terminus of the wedge to minimize twisting moments generated by the splitting forces.

9 Claims, 7 Drawing Figures

LOG SPLITTER

This is a continuation of application Ser. No. 873,060, filed Jan. 27, 1978 now abandoned.

BACKGROUND OF THE INVENTION

1. Field of the Invention

The wedge is slidably supported on a pair of upright stanchions to which it is releasably secured by a pair of quick-release clamps arranged to be actuated by one hand of the operator. The lower end of the log is supported by an upright projection that is small in surface area in comparison with the log to be split and which is in alignment, in the direction of the splitting movement, with the apex of the wedge, the arrangement being designed to minimize twisting moments during the splitting operation.

The present invention provides an economical apparatus for splitting logs that is particularly suitable for home use.

2. Description of the Prior Art

Mechanical log splitters have been in use for commercial applications, but no completely satisfactory device has been available for the individual who desires to split logs for his own use. The available commercial devices are both expensive and hazardous to use making them unacceptable for home use. Such splitters as have been made available at a price to qualify them for home use have either been ineffective, awkward to use or excessively hazardous to operate.

SUMMARY OF THE INVENTION

The log splitter embodying the present invention includes a support for the log to be split that has a projection in alignment with the terminus of a splitting wedge to reduce twisting moments and permit lighter construction. In another aspect of the invention, a quick-release clamping mechanism permits the operator to hold a log in position with one hand and, with the other hand, release the splitting wedge for movement into engagement with the log.

It is an object of this invention to provide a log splitter that is easily operated, either manually or power-driven, and which creates minimum hazard in its use.

It is another object to provide such a log splitter having a wedge with a single point that engages the end of the log to be split.

It is still another object to provide such a device which supports the log only in the central area of the bottom surface.

Another object is to provide a log splitter having a pointed splitting wedge having converging edges forming a point and converging surfaces terminating at the same point.

Another object is to provide a vertical log splitter having a movable lower support for receiving the bottom end of a log to be split and an upper splitting wedge secured to a vertical frame by a quick-release hand-operated lock.

Still another object is to provide a log splitter in which vertical forces are applied to split the log without the generation of substantial lateral forces.

DESCRIPTION OF THE PREFERRED EMBODIMENT

The log to be split is supported in a vertical position by an I-beam 2 having an upper projection 4 that engages the central area of the bottom of the log. The log is split by a wedge, generally indicated at 6 in FIGS. 1 and 2, having a point 8 that makes initial contact with the upper end of the log. The vertical design of the log splitter is advantageous in that it permits logs of different diameters to be centered readily on the projection 4 and the wedge point 8. Such centering is difficult or impossible with splitters in which the log is mounted in a horizontal position.

Figure 1:
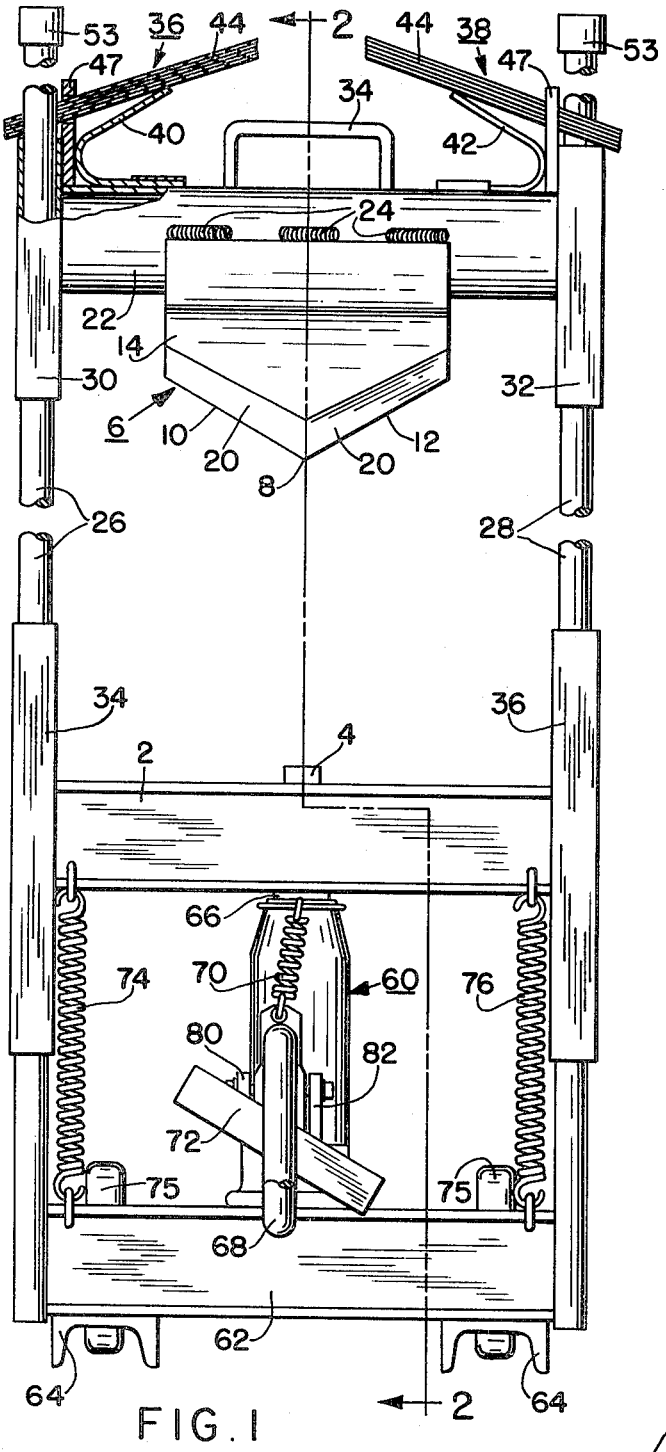
FIG. 1 is an elevational view of a log splitter embodying the invention.
Figure 2:
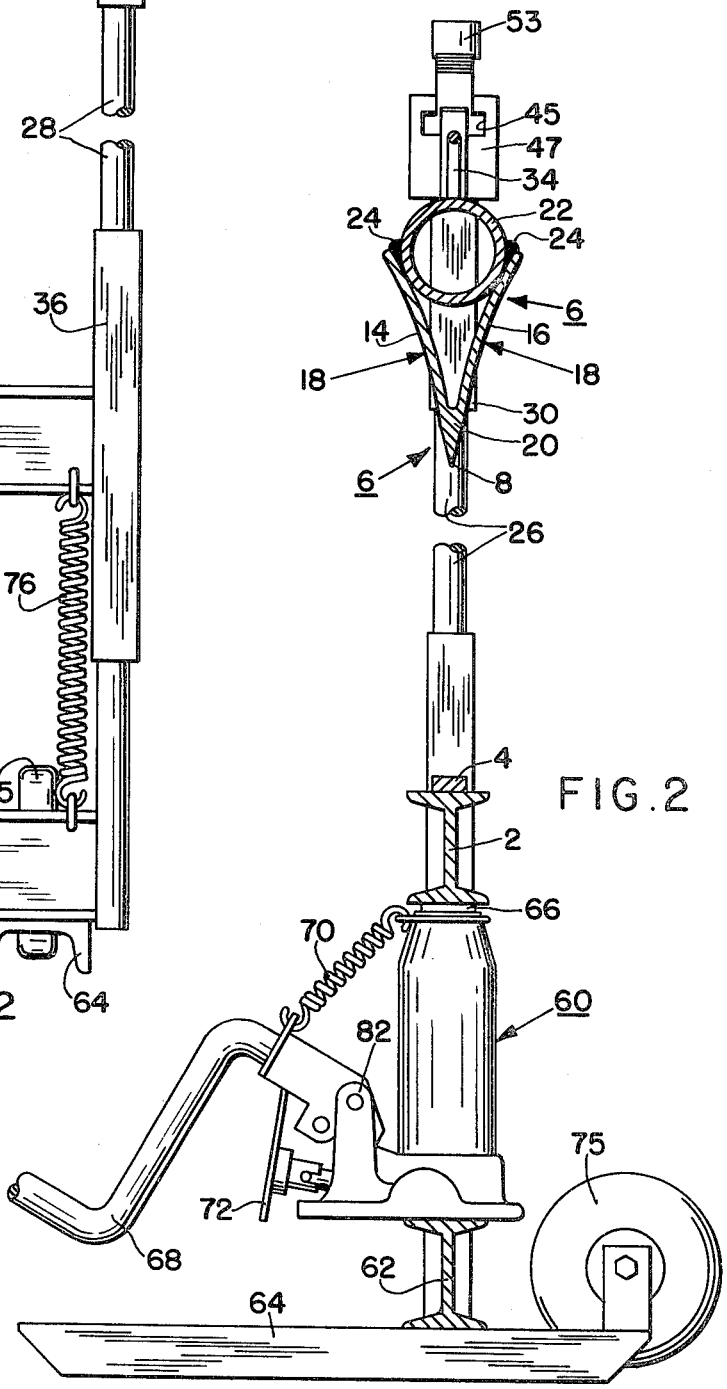
FIG. 2 is a sectional view taken along line 2—2 of FIG. 1.
Figure 4:
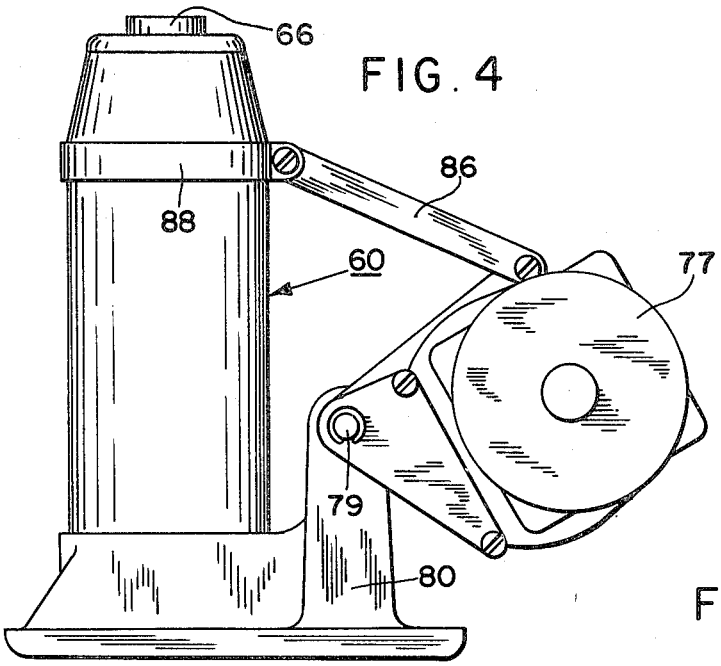
FIG. 4 is an elevational view of a power drive attached to the log splitter jack.
Figure 5:
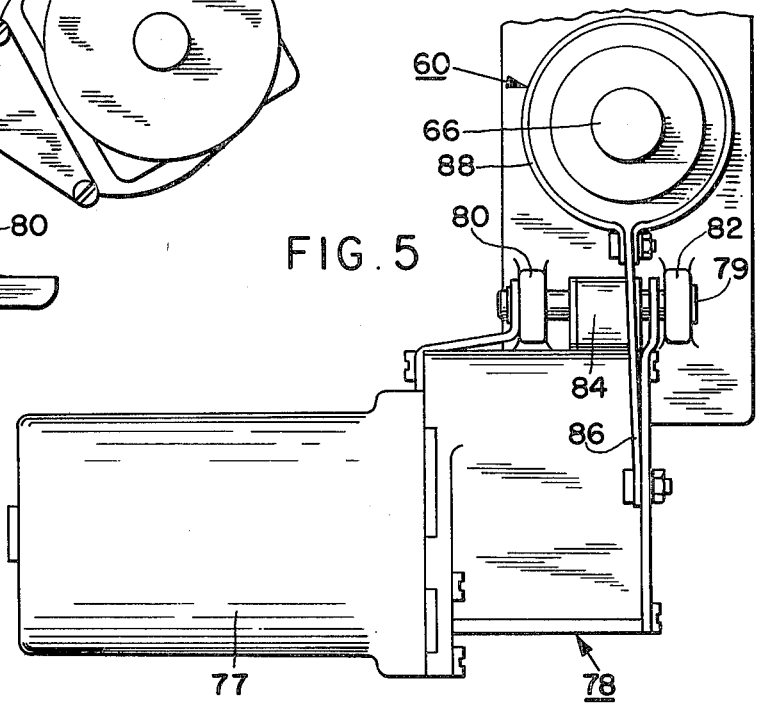
FIG. 5 is a plan view of the drive of FIG. 4.
Figure 7:
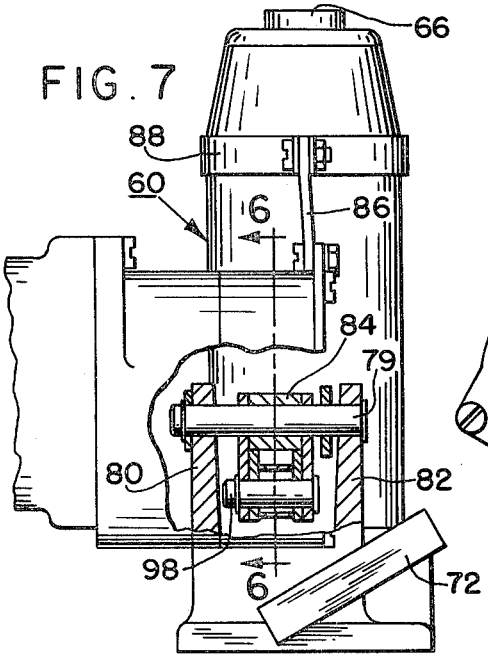
FIG. 7 is a partial sectional view taken along line 7—7 of FIG. 6.
Figure 6:
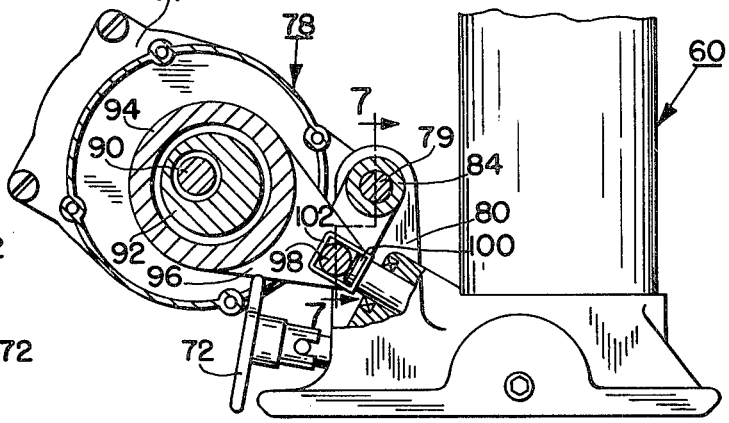
FIG. 6 is a partial sectional view of the drive taken along line 6—6 of FIG. 7.

In order to split the log with minimum force and minimum stroke, the wedge 6 is tapered in two directions. From a front view as shown in FIG. 1, the point is formed by two linear tapered edges 10 and 12. The wedge 6 is also tapered in the plane at 90 degrees from the front view of FIG. 1 as shown in FIG. 2. The wedge 6 is formed of two steel plates 14 and 16 which are curved on a radius as indicated at 18, positioned to form an acute angle, and welded together near the bottom edge to form a solid blade portion 20 that has a short linear taper that terminates in an edge along the bottom of the wedge and joins the radii 18 along its top. This double-tapered wedge construction requires less force to cause initial penetration than would a conventional wedge that makes a line contact with the end of the log and it also causes the log to split with less penetration than would be required by a conventional single-taper wedge. As used herein, the term double-tapered wedge means a wedge having two side surfaces that form an acute angle and which meet along two edges that, in another plane, form an acute angle with an apex at an extreme point of the wedge. The wedge may be formed in any desired manner, as by two separate parts welded together, or it may be cast as a single piece and machined to the desired dimensions.

Figure 3:
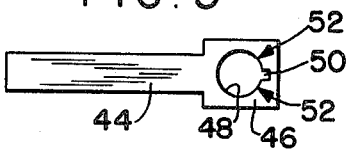
FIG. 3 is a plan view of a locking member used in the log splitter.

As shown at 24, the plates 14 and 16 are welded along their upper edges to a carriage 22 which is slidably positioned on two vertical standards, formed of steel pipe, by means of two cylindrical guides 30 and 32, of square cross section, arranged to slide vertically on the standards 26 and 28. The wedge is manually adjusted vertically by means of a handle 34 secured to the carriage 22 and locked in position by two quick-release clamps, generally indicated at 36 and 38. These clamps are normally maintained in locked position by two generally U-shaped leaf springs 40 and 42 which are secured at one end area to the carriage 22 with the free upper end of each spring exerting an upward force on a stack of five locking members 44. Each of the locking members is a flat steel plate having an enlarged rectangular end portion 46 (FIG. 3) with a central hole having a diameter slightly greater than the outside diameter of the standards 26 and 28 so that when the locking member is canted with respect to the standard, it binds against the standard and is locked in position. Each of the locking members passes through a rectangular opening 45 in a fulcrum member 47 and pivots about the upper surface of the opening 45. To prevent the scoring of the standards 26 and 28 by the clamping action from interfering with the free sliding movement of the guides 30 and 32, each of the openings in the locking members is relieved, in the area adjacent the outer surface of the standard which passes through it, by a notch 50. The clamping force is therefore applied to areas indicated at 52 in FIG. 3. If this clamping action scores the standards 26 and 28, it is of little consequence because the score marks will occur in portions of the standards passing through the corner sections of the rectangular guides that do not engage the surfaces of the round standards.

When the handle 34 is grasped, the end portions of the locking members 44 are enclosed in the grasp and moved against the force of the leaf springs 40 and 42 into a generally horizontal position releasing the lock on the standards and permitting the entire carriage and wedge assembly to be moved vertically. Upon release of the handle 34, the locks 36 and 38 re-engage the standards and secure the wedge assembly in position, locking it securely against any upward force.

In use, the wedge assembly is lifted to its highest position, the movement being limited by two top caps 53 threaded onto the standards 26 and 28, and the log is placed vertically on the projection 4 and held in that position while the carriage and wedge assembly is lowered so that the wedge point 8 engages the upper surface of the log and holds it in position. The projection 4, making essentially point contact with the log, prevents the application of a transverse force to logs having an angular lower end surface when the splitting force is applied. The projection 4, which may be of any cross-sectional shape, has a surface area small in comparison with the end area of the smallest log to be split and may, typically, have between one and eight square inches. The point contact of the wedge on the upper end also serves a similar function and prevents the development of lateral forces on logs having an angular end surface. This alignment of forces allows application of large splitting forces without generating bending moments, permitting the use of a lighter and simpler frame than would otherwise be required.

The design of the log splitter makes it possible to split logs with a diameter larger than the distance between the two standards 26 and 28, by placing the log off-center between the projection 4 and the wedge point 8 and reducing the diameter of the log by multiple splits.

The I-beam 2 is slidably supported on the standards 26 and 28 by two cylindrical guides 54 and 56, also of rectangular cross section, which fit around the standards. The guides 54 and 56 are long enough to permit relatively free movement on the standards in spite of any expected twisting or off-center forces on the I-beam 2.

With the log positioned between the I-beam 2 and the wedge 6, the splitting action is produced by forcing the beam upwardly and driving the log into the wedge 6. The necessary force is conveniently produced by a hydraulic jack, generally indicated at 60, which may be an ordinary automobile jack of the kind intended to be operated by foot action.

The hydraulic jack 60 rests on a supporting I-beam 62 which in turn is supported by two parallel steel channels 64 that serve as a stable base for the splitting unit. The movable ram 66 of the jack 60 abuts the underside of the I-beam 62 and advantageously may be positioned in a recess so the ram will not accidentally be dislodged during use.

The jack 60 has a handle 68 that is intended for vertical reciprocal movement by foot action. When the handle is forced down, the conventional cam mechanism operates the jack in the usual manner, the handle then being returned, by a spring 70, to its upward position upon release of the downward force. Movement of the handle forces the I-beam upwardly to produce the compressive force between the log and the wedge 6.

When the log has been split, the hydraulic pressure in the jack 60 is released by a foot-operated lever 72 and the I-beam 2 is returned to its lowermost position by two tension springs 74 and 76 extending between the two beams 2 and 62.

For reasons of economy and to minimize the overall height of the structure, the jack 60 has a relatively short stroke, for example, about six inches, which is sufficient with the wedge structure already described to split most logs. However, if a longer stroke is needed to complete the splitting action, the jack 60 is allowed to return to its retracted position, by operation of the lever 72, while the clamps 36 and 38 are held in release position. The entire log-holding assembly is then moved downwardly so that the full stroke of the jack 60 is again available to drive the wedge 6 farther into the log. The log splitting apparatus described is particularly safe to operate because of the slow movement of the parts and the absence of lateral forces.

In order that the log splitter may be easily moved from one location to another, a pair of wheels 75 are attached near the ends of the base channels 64. By tilting the entire splitter so that it is balanced on the wheels 75, it can be moved readily in the manner of a conventional hand truck.

The required manual labor is reduced and the speed of the splitting operation is increased by the use of a power drive. The electric drive system shown in FIGS. 4–7 is particularly well adapted for this purpose. It is attached to the jack 60 with a minimum of modifications so that it is possible to add the electric drive to the same jack that is used for manual operation.

A universal electric motor 77 is coupled to a speed-reducing transmission, generally indicated at 78, which may be of any desired type, such as the one described in my U.S. Pat. No. 3,574,489. The motor and speed reducing transmission are mounted on the jack 60 by a pin 79 extending between the mounting brackets 80 and 82 and through a mounting collar 84 on the housing of the motor and speed reducing unit. The pin 79 is used as a pivotal mounting for the jack handle 68 in the manually-operated embodiment. The housing is also secured to the jack by an arm 86 extending between the housing of the speed reducer and a collar 88 around the body of the jack.

To produce the necessary reciprocating motion, the driven shaft 90 from the speed reducer 78 is secured to a drive disk 92 mounted eccentrically on the shaft 90 and which is surrounded by a sliding collar assembly 94. This collar assembly includes a pair of spaced arms 96 connected by a cross pin 98 which is maintained in abutment with the end of the jack piston 100 by a U-shaped clip 102. Rotation of the shaft 90 produces a reciprocating motion of the piston 100 and causes the ram 66 of the jack to move upwardly. The pressure release of the jack is controlled in the same manner as with the manually-operated unit.

The electric drive unit is mounted directly on the jack 60 and may be removed as an integral part with the jack from the remainder of the log splitter assembly. Thus, the electrically driven jack may be used for a wide variety of applications where economy is important and it is desired to take advantage of the low cost of commercial hydraulic jacks. It is to be noted that the motor drive unit can be used to convert any standard commercial hand-operated hydraulic pump or self-contained lifting jack into a power-operated unit at a fraction of the cost of conventional systems. No modification of the pump is required and there are no hoses or separate valving systems to be provided. The drive configuration with its linkage method of attachment to the pump is simple, effective, and requires no precision machining.

From the foregoing description of particular embodiments of my invention it will be apparent that my invention is well adapted to meet the ends and objects herein set forth, to be economically manufactured, and that it is subject to a wide variety of modifications to best adapt it for each intended application.

I claim:

1. In apparatus for splitting a log, the combination comprising a frame, a support slidably mounted on said frame and adapted to engage one end of a log to be split, a carriage slidably mounted on said frame, a wedge secured to said carriage and adapted to engage the opposite end of said log, manual quick-release clamping means slidably mounted with respect to said frame including spring means normally clamping said carriage to said frame and lever means arranged to be actuated with one hand against the force of said spring means to release said carriage from said frame, and drive means arranged to cause relative closing movement between said support and said wedge thereby to force said wedge into said log.

2. Apparatus as claimed in claim 1 wherein said frame includes two spaced parallel standards, and said clamping means includes a pair of spring-biased clamps each securing said carriage to one of said standards, said lever means being arranged to release said clamps substantially simultaneously from said standards.

3. Apparatus as claimed in claim 1 wherein said wedge has converging edges and opposing converging surfaces and said edges and said surface terminate in a single centrally located point adapted to engage said log.

4. Apparatus as claimed in claims 1, 2 or 3 including a base forming part of said frame and wherein said drive means is a hydraulic jack positioned on said base and arranged to move said support toward said wedge.

5. Apparatus as claimed in claim 2 wherein said carriage is arranged for movement in a substantially vertical direction, said support is positioned below said carriage and includes an upper surface, and a projection extending upwardly from said surface in the direction of said wedge and having a top area, spaced from said surface, of at least one square inch, said projection being arranged to engage the lower end of said log and adapted to prevent contact between the end of said log and the said surface of said support adjacent said projection.

6. In apparatus for splitting a log, the combination comprising a frame, a carriage mounted on said frame, a wedge secured to said carriage and having a terminus adapted to engage one end of a log to be split, support means for the opposite end of said log, and drive means arranged to produce relative closing movement between said support means and said carriage, said support means having a first surface generally facing said wedge, a projection extending from said first surface in alignment with said terminus in the direction of the path of said closing movement, said projection having a second surface of a least one square inch generally facing said wedge and being spaced from said first surface and adapted to engage said opposite end of said log and prevent contact between said log and said first surface adjacent said projection thereby to minimize the generation of twisting moments.

7. Apparatus as claimed in claim 6 wherein said wedge has converging edges and opposing converging surfaces, and said edges and said surfaces terminate in said terminus.

8. Apparatus as claimed in claim 6 wherein said frame includes two spaced parallel standards, said support means is positioned below said carriage and said projection extends upwardly from said first surface.

9. Apparatus as claimed in claims 6, 7 or 8 wherein said second surface has an area not greater than eight square inches.

* * * * *